US009546014B2

(12) United States Patent
Smith

(10) Patent No.: US 9,546,014 B2
(45) Date of Patent: Jan. 17, 2017

(54) ADJUSTABLE CONTAINER

(71) Applicant: International Paper Company, Memphis, TN (US)

(72) Inventor: Jeffrey A. Smith, Medford, NJ (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 14/619,517

(22) Filed: Feb. 11, 2015

(65) Prior Publication Data

US 2016/0229581 A1 Aug. 11, 2016

(51) Int. Cl.
*B65D 5/00* (2006.01)
*B65D 5/355* (2006.01)

(52) U.S. Cl.
CPC ... *B65D 5/0005* (2013.01); *B65D 2571/00512* (2013.01)

(58) Field of Classification Search
CPC ..... B65D 5/0005; B65D 2571/00512
USPC ..... 229/101, 101.1, 103, 117.01; 220/8
See application file for complete search history.

(56) References Cited

U.S. PATENT DOCUMENTS 3,148,799 A * 9/1964 Meroney ..... B65F 1/0006 206/524.5
3,251,532 A 5/1966 Hechtman et al.
3,310,220 A 3/1967 Feldman
3,598,303 A 8/1971 Folz
3,672,558 A * 6/1972 Johnson ..... B65D 5/0005 229/101
4,452,367 A 6/1984 Wein
4,511,079 A 4/1985 Lopez
5,192,019 A 3/1993 Meehan
6,676,012 B1 1/2004 Southwell et al.
2006/0124712 A1 6/2006 Weimer, Jr.
2006/0273143 A1* 12/2006 Finch ..... B65D 5/0005 229/117.01
2011/0226649 A1 9/2011 Dye et al.

FOREIGN PATENT DOCUMENTS

CN 201619772 U 11/2010
FR 2799440 10/1999
GB 970495 9/1964

* cited by examiner

*Primary Examiner* — Christopher Demeree
(74) *Attorney, Agent, or Firm* — Matthew M. Eslami

(57) ABSTRACT

An adjustable container capable of being converted from an expanded position to a contracted position and comprises a bottom wall, opposite sidewalls, and opposite end walls foldably joined to one another to form an interior space for containing articles. Each of the opposite sidewalls includes a pair of first gusset panels each of which including two identical coextensive panels having the same height as the side walls and is configured to be perpendicular to the respective sidewalls and the bottom wall. The bottom wall includes a second gusset panels that is defined by two identical coextensive panels and having the same height as the side walls and is folded upwardly out of the plane of the bottom wall and perpendicular thereto when the adjustable container is in the contracted position. The adjustable container also includes an adjustable sleeve that is used to securely cover the container during shipping and transportation.

15 Claims, 6 Drawing Sheets

ADJUSTABLE CONTAINER

FIELD OF THE INVENTION

This invention generally relates to adjustable containers and more particularly, to a corrugated adjustable container capable of being adjusted to a different size so that the adjusted container accommodates to various weighted and sized products.

BACKGROUND OF THE INVENTION

Various types of containers/trays have been formed from corrugated paperboard in the past for use in packaging and shipping different kinds of merchandise. Such containers/trays are generally cut from a flat corrugated sheet and are then folded along score lines to form a tray/container for containing various goods. Recently, major global package delivery companies such as UPS and FedEx have decided to impose dimensional weight pricing for everything shipped by ground or air carriers. Dimensional weight reflects package density, which is the amount of space a package occupies in relation to its actual weight. Since the dimensional weight is calculated based on the length, height, and width of the package, then the dimensional weight becomes the billable weight when the dimensional weight of a package exceeds its actual weight. Many businesses use a few standard container sizes for all shipments without realizing the impact of dimensional weight on their shipping costs. Therefore, many businesses need to evaluate their packaging to ensure that they are using the appropriate size containers for their products.

Accordingly, there is need for an adjustable container which is capable of expanding and contracting based on the size of products contain therein and to provide various businesses with the flexibility of using the adjustable container for their shipments.

SUMMARY OF THE INVENTION

The present invention is directed to an adjustable container that is capable of expanding and contracting based on the size of products contain therein. The adjustable container is particularly useful for shipping products since the interior space can be adjusted and therefore provides significant saving in shipping costs when the dimensional weight calculation is larger than the actual weight of the products.

Accordingly, the one aspect of the present invention is directed to an adjustable container comprises a bottom wall, opposite side walls, and opposite end walls foldably joined to one another to form an open-top adjustable interior space for containing articles. The adjustable interior space includes first gusset panels in the respective opposite side walls joined along fold lines extending perpendicular to the bottom wall. The first gusset panels have bottom edges separated from the bottom wall by a cut line and having an unfolded position extending coplanar with one another and with the associated respective sidewalls and a folded position in which the first gusset panels in each respective sidewall are folded inwardly with respect to the associated sidewall. Each of the first gusset panels is defined by two identical coextensive panels having the same heights as the side walls. The first gusset panels in each of the respective opposite side walls are formed diagonally opposite with one another to facilitate shortening the length of the adjustable container. Second gusset panels in the bottom wall are joined along fold lines extending transversely of the bottom wall.

The second gusset panels have opposite side edges separated from adjacent sidewalls by a cut line and having unfolded position extending coplanar with one another and with the bottom wall and a folded position folded upwardly out of the plane of the bottom wall. The second gusset panels are defined by two identical coextensive panels having a height that is the same as the side walls. The adjustable container is reducible when the first and second gusset panels are folded out of the plane of their respective sidewalls.

The adjustable container further comprises an adjustable sleeve that is used to securely cover the adjustable container during shipping and transportation. The adjustable sleeve is shortened in length by removing a portion thereof so as to have the same length as the adjustable container. The adjustable container has an adjustable length so that the container can be folded into shortened position for shipping and an extended position for use or display. The adjustable length of the container can be shortened two times the height of the respective side walls. Each of the respective first gusset panel is locked against each respective sidewall via a groove formed by the respective end walls.

Another aspect of the present invention is directed to an adjustable container capable of being converted from an expanded position to a contracted position and comprises a bottom wall, opposite sidewalls, and opposite end walls foldably joined to one another to form an interior space for containing articles. Each of the opposite sidewalls includes a pair of first gusset panels each of which including two identical coextensive panels and having the same height as the side walls and is configured to be perpendicular to the respective sidewalls and the bottom wall. The bottom wall includes a pair of second gusset panels that is defined by two identical coextensive panels and having the same height as the side walls and is folded upwardly out of the plane of the bottom wall and perpendicular thereto when the adjustable container is in the contracted position. The adjustable container also includes an adjustable sleeve that is used to securely cover the container during shipping and transportation.

A further aspect of the present invention is directed to a container having an adjustable length so that the container can be folded into a shortened position for shipping and an extended position for use or display. The container comprises a bottom wall, opposite side walls, and opposite end walls. First gusset panels in the side walls are joined along fold lines extending perpendicular to the bottom wall. The first gusset panels have bottom edges separated from the bottom wall by a cut line and having an unfolded position extending coplanar with one another and with the associated respective side walls and a folded position in which the first gusset panels in each respective sidewall are folded inwardly with respect to the associated side wall. Second gusset panels in the bottom wall are joined along fold lines extending transversely of the bottom wall. The second gusset panels have opposite side edges separated from adjacent side walls by a cut line and having unfolded position extending coplanar with one another and with the bottom wall and a folded position folded upwardly out of the plane of the bottom wall. The length of the container is shortened when the first and second gusset panels are folded out of plane of their respective side walls and bottom wall.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
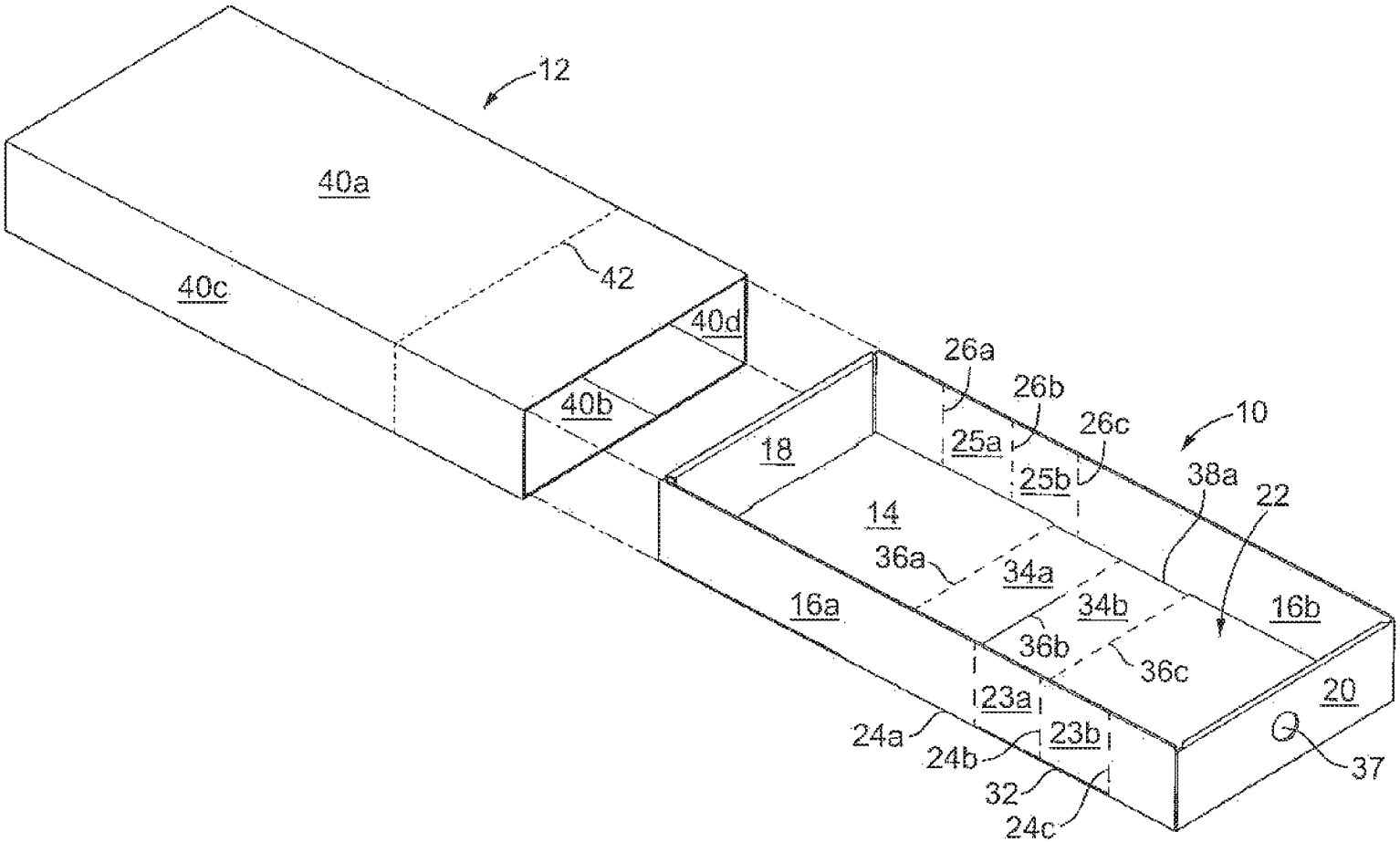
FIG. 1 is an exploded top perspective view of an adjustable container being illustrated in an expanded position and having an adjustable sleeve positioned in a spaced relationship thereof in accordance to a preferred embodiment of the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same. In addition, the adjustable display tray or expandable display tray are used interchangeably.

Figure 3A:
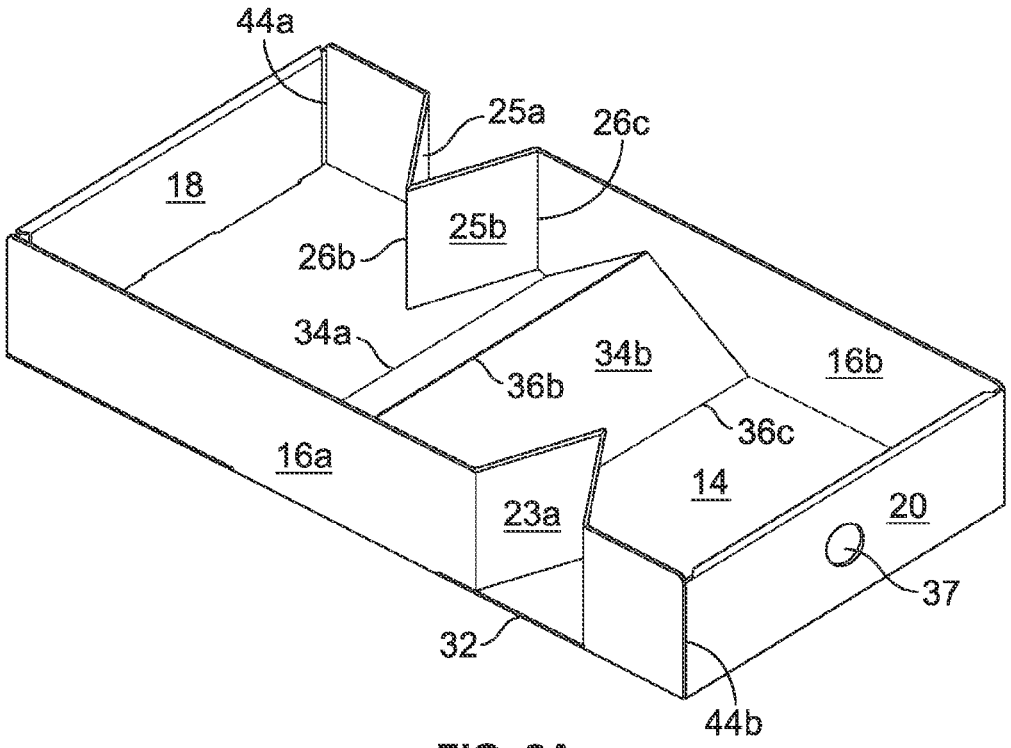
FIGS. 3A-3D illustrate the manner in which the adjustable container of FIG. 1 is converted from an expanded configuration to a contracted configuration.
Figure 3B:
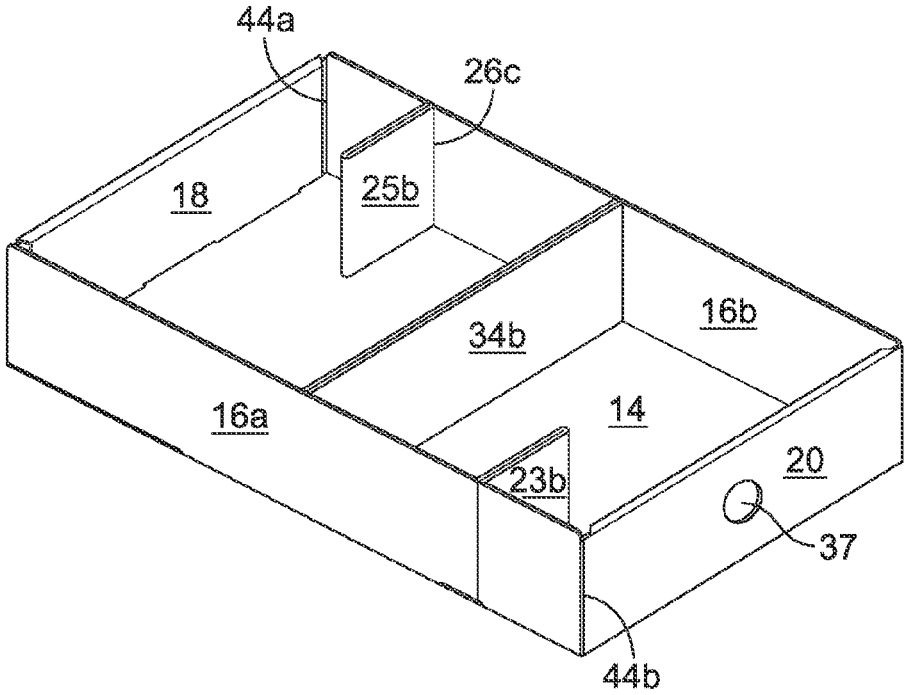
Figure 3C:
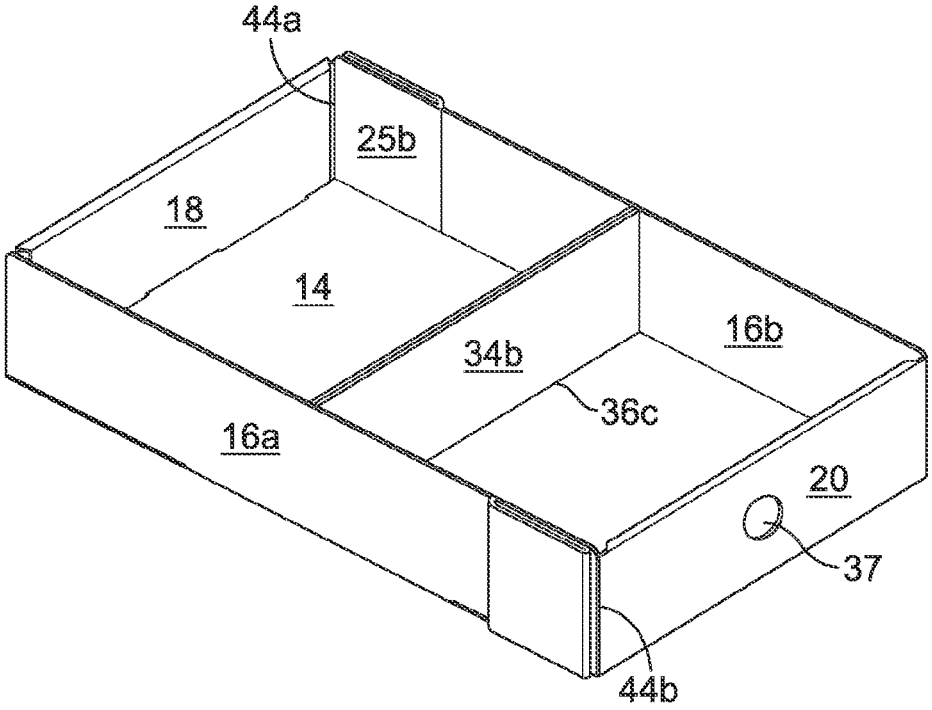
Figure 3D:
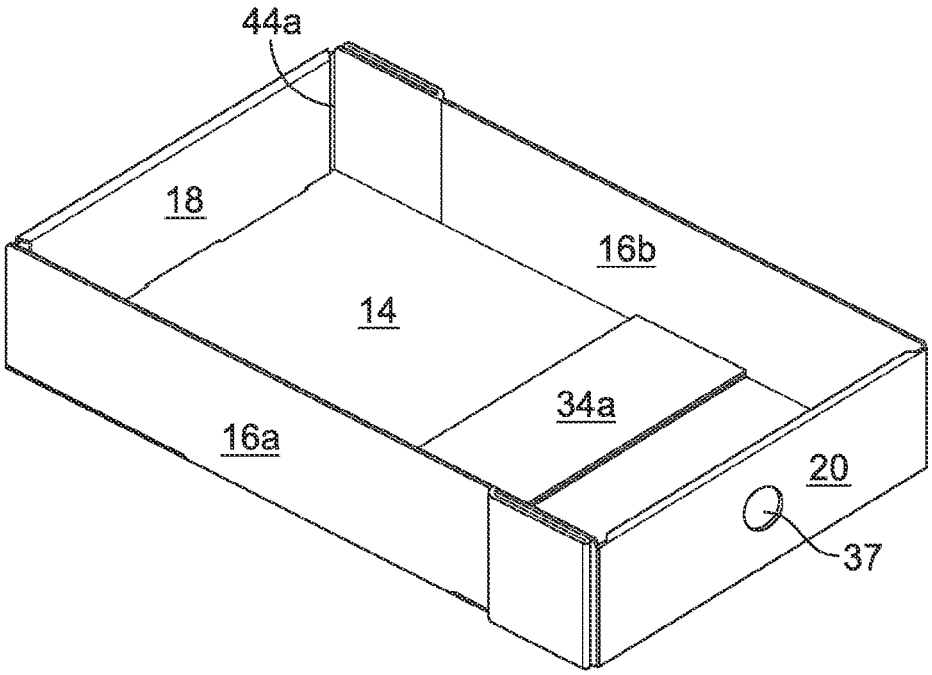

FIG. 1 is an exploded top perspective view of an adjustable container 10 being illustrated in an expanded position and having an adjustable sleeve 12 positioned in a spaced relationship thereto to in accordance to a preferred embodiment of the invention. The adjustable container 10 is capable of expanding and contracting based on the size of products contain therein and providing the users with the flexibility of using the adjustable container 10 for their shipments. The adjustable container 10 is highly attractive to global package delivery companies such as UPS and FedEx that have decided to impose dimensional weight pricing for everything shipped by ground or air carriers. In the expanded configuration, the adjustable container 10 includes a bottom wall 14, respective opposite side walls 16*a*, 16*b*, and respective opposite end walls 18 and 20 foldably joined to one another to form an open-top adjustable interior space 22 to receive various products or articles. Each of the respective opposite side walls 16*a* and 16*b* includes a respective pair of first gusset panels 23*a*, 23*b* and 25*a*, 25*b*. The first gusset panels 23*a*, 23*b* are identical with one another and are formed by three spaced apart fold lines 24*a*, 24*b*, 24*c* and the first gusset panels 25*a*, 25*b* are identical with one another and are formed by three spaced apart fold lines 26*a*, 26*b*, 26*c*. The fold lines 24*a*, 24*b*, 24*c* and 26*a*, 26*b*, 26*c* are perpendicular to the bottom wall 14. Each of the respective first gusset panels has a respective bottom edge 28 and 30 (FIG. 3A) which is separated from the bottom wall 14 by a cut line 32. In the expanded position, the respective first gusset panels 23*a*, 23*b* and 25*a*, 25*b* extend coplanar with the respective side walls 16*a*, 16*b*. The respective first gusset panels 23*a*, 23*b* and 25*a*, 25*b* formed diagonally opposite with one another to facilitate shortening of the length of the adjustable container 10.

The bottom wall 14 includes second gusset panels 34*a*, 34*b* that are formed by three parallel spaced apart fold lines 36*a*, 36*b*, and 36*c*. The second gusset panels 34*a*, 34*b* are formed in the central portion of the bottom wall 14 and they extend coplanar with the bottom wall in the expanded position. The fold lines 36*a*, 36*b*, 36*c* extend transversely of the bottom wall and they are perpendicular to the respective side walls 16*a*, 16*b*. The second gusset panels 34*a*, 34*b* includes respective side edges which are separated from the respective side walls 16*a*, 16*b* by respective cut lines 38*a* and 38*b* as seen best in FIG. 5A. The first gusset panels 23*a*, 23*b* and the second gusset panels 34*a*, 34*b* are used to expand or to contract the adjustable container 10 as will be discussed in greater detail hereinafter. Each of the respective end walls 18, 20 includes a hand hole 37 that is used to pull out the adjustable container 10 from the adjustable sleeve 12. The adjustable sleeve 12 is an open ended rectangular shaped tube which corresponds to the shape and size of the adjustable container 10. The adjustable sleeve 12 includes four sides 40*a*, 40*b*, 40*c*, and 40*d* foldably joined to one another to construct the open ended rectangular shaped tube. Furthermore, the adjustable sleeve 12 includes a frangible line 42 that is used to remove a portion of the sleeve 12 so that the length of the sleeve 12 corresponds to the shortened length of the adjustable container 10, when the adjustable container 10 is in the contracted position. However, one of ordinary skilled in the art would appreciate that a lid or other cover top can used to enclose the adjustable container and they are within the scope of invention. In addition, it is within the scope of the invention that a strip panel is formed between the second gusset panels 34*a*, 34*b* so that in the folded position, a bridge or landing is formed between panels 34*a* and 34*b*.

Figure 2:
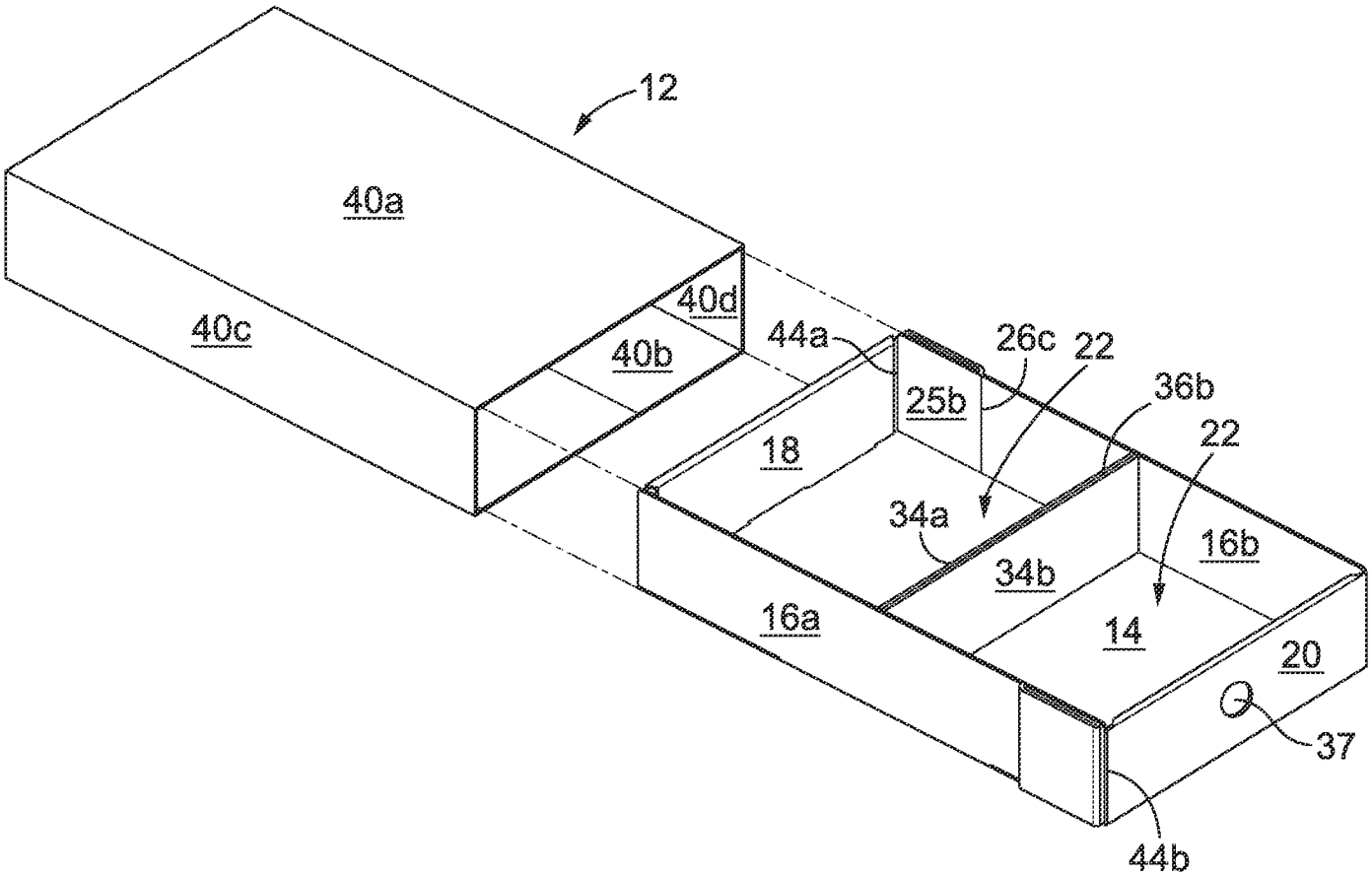
FIG. 2 is a top perspective view of the adjustable container of FIG. 1 being illustrated in a contracted position and having the sleeve positioned in a spaced relationship thereof.
Figure 4A:
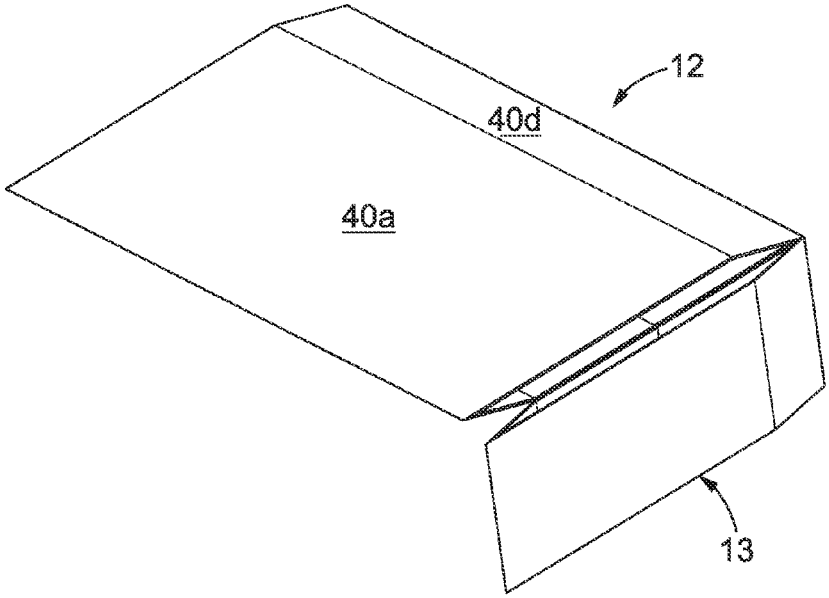
FIGS. 4A and 4B illustrate the manner in which the adjustable sleeve of FIG. 1 is shortened.
Figure 4B:
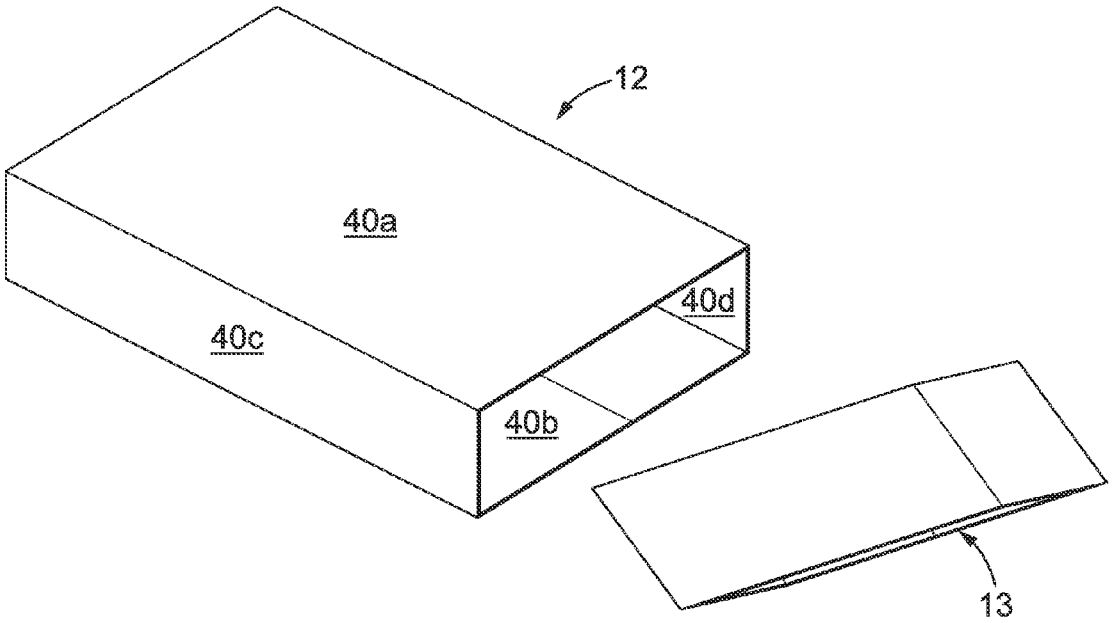

FIG. 2 is a top perspective view of the adjustable container 10 shown in FIG. 1 which is illustrated in a contracted position and having the sleeve positioned in a spaced relationship thereof. In the contracted configuration, the respective first gusset panels 23*a*, 23*b* and 25*a*, 25*b* are folded inwardly against the respective inner side of the respective side walls 16*a*, 16*b* and the second gusset panels 34*a*, 34*b* are folded upwardly out of the plane of the bottom wall 14. The second gusset panels 34*a*, 34*b* divides the interior space 22 into two compartments for containing the articles and acts as a center divider. It should be noted that length of the adjustable container 10 can be shortened two times the height of the respective side walls. For example, if the height or depth of the respective side walls 16*a*, 16*b* is 3 inches, then the corresponding length of the container is shortened or reduced by 6 inches. The adjustable sleeve 12 is shortened by removing a portion 13 as best illustrated in FIGS. 4A and 4B so that the length of the sleeve is corresponded to the length of the adjustable container 10 when they are engaged with one another.

FIGS. 3A-3D illustrates the manner in which the adjustable container 10 of FIG. 1 is converted from an expanded configuration in FIG. 1 to a contracted configuration in FIG. 2. Upon forcing the respective opposite end walls 18 and 20 toward one another, the respective first gusset panels 23*a*, 23*b* and 25*a*, 25*b* and the second gusset panels 34*a*, 34*b* are folded via fold lines 24*b*, 26*b*, and 36*a*. For example, the first gusset panels 23*a*, 23*b* and 25*a*, 25*b* are simultaneously folded inwardly along respective fold lines 24*b* and 26*b* so that the panels 23*a* and 23*b* are coextensively folded onto one another and the panels 25*a* and 25*b* are coextensively folded onto one another as well. Likewise, the second gusset panels 34*a*, 34*b* are coextensively folded upwardly out of the plane of the bottom wall 14. In the contracted position, the first gusset panels 23*a*, 23*b* and 25*a*, 25*b* provide stability and integrity to the container 10 by being pushed against the respective side walls 16*a*, 16*b* and locked into respective grooves 44*a*, 44*b* as depicted in FIGS. 2, 3B, 3C, and 3D. Alternatively, the first gusset panels 23*a*, 23*b* and 25*a*, 25*b* can be used as partial dividers in which they are held perpendicular to their respective side walls 16*a*, 16*b* by the products contained therein. The end user may stock one item that will adjust to several sizes, which in turn helps the user with flexible inventory. Similarly, the second gusset panels 34*a*, 34*b* can be used as a center divider in which they are perpendicular to the bottom wall 14. If the second gusset panels 34*a*, 34*b* or the center divider are not needed, then it can be pushed flat against the bottom wall 14 and it may be possible to increase the change in length of the container 10 to half of the width, rather than two times of the depth or height of side walls as described hereinabove.

Figure 5B:
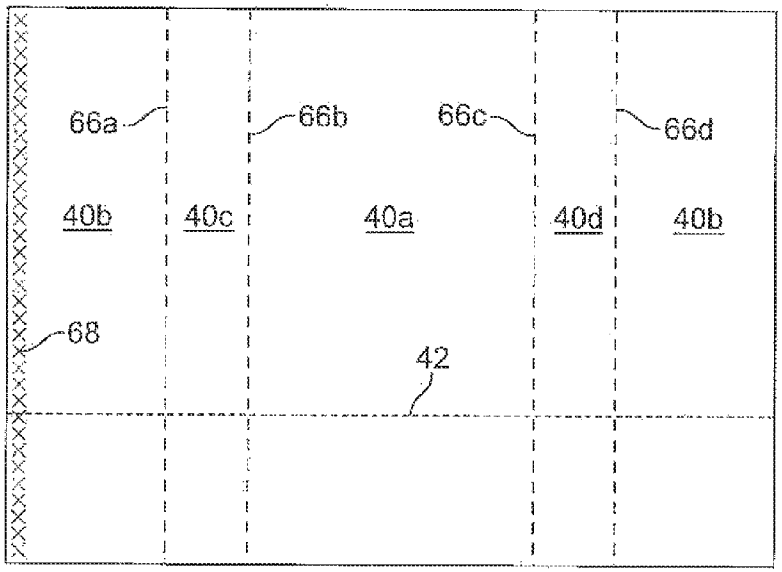
FIG. 5B is a top plan view of a blank for making the adjustable sleeve shown in FIG. 1.
Figure 5A:
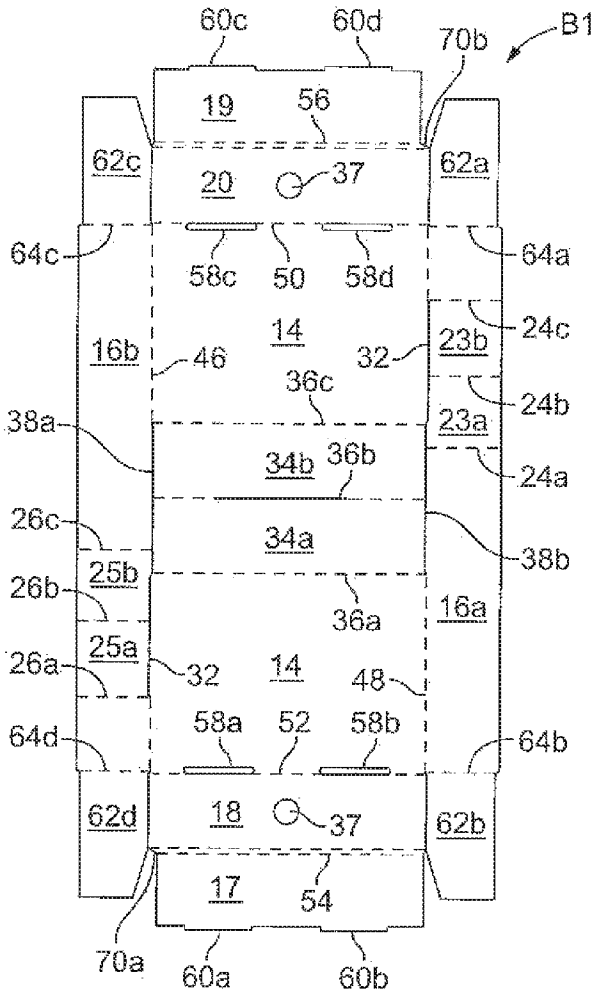
FIG. 5A is a top plan view of a one-piece blank for making the adjustable container of FIG. 1 in accordance to a preferred embodiment of the invention.

FIG. 5A is a top plan view of a one-piece blank B1 for making the adjustable container of FIG. 1 in accordance to a preferred embodiment of the invention. The blank B1 is substantially flat symmetrical with respect to its longitudinal axis thereof. The blank B1 is preferably an integral piece of a material such as continuous sheet of conventional corrugated paperboard. The blank B1 is cut along its outer margins to form its specific shape of the adjustable container 10. The blank B1 is divided into a bottom wall 14, side wall panels 16*a*, 16*b*, and end wall panels 18, and 20 via fold lines 46, 48, 50, and 52. For example, side wall panels 16*a* and 16*b* are defined by fold lines 46, 48 from respective longitudinal edges of bottom wall panel 14 and the end wall panels 18 and 20 are defined from respective lateral edges of bottom wall panel 14. Each of the end wall panels 18 and 20 includes respective rolled-over flap panels 17 and 19 defined by respective fold lines 54 and 56. Each of the rolled-over flap panels 17 and 19 includes two respective spaced apart tabs 60*a*, 60*b* and 60*c*, 60*d* that are inserted to their corresponding slots 58*a*, 58*b*, 58*c*, and 58*d* when the blank B1 is fully constructed.

The respective side wall panels 16*a* and 16*b* each of which includes two opposed depending flanges 62*a*, 62*b* and 62*c*, and 62*d* that each of the depending flanges extends from their respective lateral edges via respective fold lines 64*a*, 64*b*, 64*c*, and 64*d*. Each of the opposite side walls 16*a*, 16*b* includes respective three space apart fold lines 24*a*, 24*b*, 24*c* and 26*a*, 26*b*, 26*c* formed therein which form the respective first gusset panels 23*a*, 23*b* and 25*a*, 25*b* as described hereinabove. The fold lines 24*a*, 24*b*, 24*c* are equally spaced apart from one another and they are formed on the lateral side of the side wall 16*a*. The fold lines 26*a*, 26*b*, 26*c* are equally spaced apart from one another and they are formed on the lateral side of the side wall 16*b*. The bottom wall 14 includes second gusset panels 34*a*, 34*b* that are formed by three parallel spaced apart fold lines 36*a*, 36*b*, and 36*c*. The second gusset panels 34*a*, 34*b* are formed in the central portion of the bottom wall 14 and they extend coplanar with the bottom wall. The fold lines 36*a*, 36*b*, 36*c* extend transversely of the bottom wall 14 and they are perpendicular to the respective side walls 16*a*, 16*b* when the blank B1 is fully constructed. The second gusset panels 34*a*, 34*b* include respective side edges which are separated from the respective side wall panels 16*a* and 16*b* by respective cut lines 38*a* and 38*b*. Each of the end walls 18 includes a hand hole opening 37 that is used to pull out the adjustable container 10 from the adjustable sleeve 12 when the blank B1 is fully constructed. The respective angle cuts 70*a*, 70*b* are formed strategically so that when the blank B1 is in the folded position, the angle cuts 70*a*, 70*b* construct the respective grooves 44*a*, 44*b* as depicted in FIGS. 2, 3B, 3C, and 3D. The blank B1 used to form the adjustable container 10 has a symmetrical design, which reduces erecting and closing labor. The lay flat design of the blank B1 speeds the cutting and packaging process and facilitates easy shelving.

The manual set-up of the blank B1 to form the adjustable display tray 10 is easily accomplished. However, one of ordinary skill in the art would appreciate that generally a folding machine may alternatively perform the forming operations. The blank B1 is laid horizontally and the inner and the side wall panels 16*a*, 16*b* are folded at right angle with respect to the respective fold lines 46 and 48. Next, the respective depending flanges 62*a*, 62*b*, 62*c*, 62*d* are folded inwardly toward each other at right angle so that they positioned on the fold lines 50, 52 and then the end walls 18 and 20 are folded upwardly at right angle to engage with the depending flanges. Finally, the respective rolled-over flap panels 17 and 19 are folded along the respective fold lines 54 and 56 so that respective tabs 60*a*, 60*b* and 60*c*, 60*d* are inserted to their corresponding slots 58*a*, 58*b*, 58*c*, and 58*d*. in the folded position, the respective depending flanges 62*a*, 62*c* are sandwiched between the end wall panels 19 and 20 and the respective depending flanges 62*b*, 62*d* are sandwiched between the end wall panels 17 and 18 which securely hold the side walls and end walls together.

FIG. 5B is a top plan view of a blank B2 for making the adjustable sleeve 12 shown in FIG. 1. The blank B2 is divided into five wall panels 40*a*, 40*b*, 40*b*, 40*c*, and 40*d* via fold lines 66*a*, 66*b*, 66*c*, and 66*d*. In the folded position, the two wall panels 40*b* form one wall via a glue area 68. The wall panels 40*a* or 40*b* correspond to the bottom wall or and the top side of the container 10 and the wall panels 40*c* and 40*d* correspond to the side walls 16*a*, 16*b*. The frangible fold line 42 is transversely formed with respect to the fold line 66*a*, 66*b*, 66*c*, and 66*d* so that a portion of the sleeve 12 can be removed, when needed. To construct the blank B2, the two wall panels 40*b* and the side walls 40*c*, 40*d* are simultaneously folded up along the respective fold lines 66*b*, 66*c* and then continue folded inwardly toward one another so that one of the wall panels 40*b* with the glue area 68 is attached to the other wall panel 40*b*.

The adjustable container 10 is particularly useful for shipping products since the interior space can be adjusted and therefore the shipping cost is significantly reduced. For example, recently major global package delivery companies such as UPS and FedEx have decided to impose dimensional weight pricing for everything shipped by ground or air carriers. Dimensional weight reflects package density, which is the amount of space a package occupies in relation to its actual weight. Since the dimensional weight is calculated based on the length, height, and width of the package, then the dimensional weight becomes the billable weight when the dimensional weight of a package exceeds its actual weight. Many businesses use a few standard container sizes for all shipments without realizing the impact of dimensional weight on their shipping costs. Therefore, many business need to evaluate their packaging to ensure that they are using the appropriate size containers for their products. The adjustable container 10 can be adjusted to ship less air and provides significant saving in shipping costs when the dimensional weight calculation is larger than the actual weight. Moreover, the adjustable container 10 can be used in a stacking tray scenario and adjust to fit different sizes of produce clamshells.

In use, depending on the size of products, the container 10 can be adjusted so that various products are disposed into the adjustable container 10. Then the sleeve 12 slide over to cover the container 10 so that the adjustable container 10 is transported to a retail store. As products are removed by customers from the adjustable container 10, the retailer can adjust the container 10 so as to provide valuable extra space on the shelf for other adjacent products. The adjustable container 10 provides various flexibilities to the retailers with respect to their valuable shelf space for displaying products for sell.

It should now be appreciated that the present invention provides a material-saving, quickly erected adjustable container 10 especially useful in retaining, transporting variety of products to retail stores.

Numerous modifications and variations on the present invention are possible in light of the above teachings. It is, therefore, to be understood that within the scope of the accompanying claims, the invention may be practiced otherwise than as specifically described herein.

It should be understood that fold lines and score line as used herein may be used interchangeably so long as the function of the line is not destroyed.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An adjustable container comprising:

a bottom wall, opposite side walls, and opposite end walls foldably joined to one another to form an open-top adjustable interior space for containing articles, the adjustable interior space includes:

first gusset panels in the respective opposite side walls joined along fold lines extending perpendicular to the bottom wall, the first gusset panels having bottom edges separated from the bottom wall by a cut and having an unfolded position extending coplanar with one another and with the associated respective sidewalls and a folded position in which the first gusset panels in each respective sidewall are folded inwardly with respect to the associated sidewall; and second gusset panels in the bottom wall joined along fold lines extending transversely of the bottom wall, the second gusset panels having opposite side edges separated from adjacent sidewalls by a cut line and having unfolded position extending coplanar with one another and with the bottom wall and a folded position folded upwardly out of the plane of the bottom wall wherein the adjustable container being reducible when the first and second gusset panels being folded out of the plane of their respective sidewalls.

2. The adjustable container of claim 1 further comprising an adjustable sleeve being used to securely cover the adjustable container during shipping and transportation.

3. The adjustable container of claim 2 wherein the adjustable sleeve is shortened in length by removing a portion thereof so as to have the same length as the adjustable container.

4. The adjustable container of claim 1 wherein the adjustable container has an adjustable length so that the container can be folded into shortened position for shipping and an extended position for use.

5. The adjustable container of claim 1 wherein each of the first gusset panels is defined by two identical coextensive panels having the same heights as the side walls.

6. The adjustable container of claim 1 wherein each of the second gusset panels is defined by two identical coextensive panels having a height that is the same as the side walls.

7. The adjustable container of claim 1 wherein the first gusset panels in each of the respective opposite side walls are formed diagonally opposite with one another to facilitate shortening the length of the adjustable container.

8. The adjustable container of claim 1 wherein the adjustable length of the container can be shortened two times the height of the respective side walls.

9. The adjustable container of claim 1 wherein each of the respective first gusset panel is locked against each respective sidewall via a groove formed by the respective end walls.

10. An adjustable container capable of being converted from an expanded position to a contracted position comprising:

a bottom wall, opposite sidewalls, and opposite end walls foldably joined to one another to form an interior space for containing articles, each of the opposite sidewalls includes a pair of first gusset panels each of which including two identical coextensive panels having the same height as the side walls and configured to be perpendicular to the respective sidewalls and the bottom wall, the pair of first gusset panels includes bottom edges separated from the bottom wall by a cut line and wherein the bottom wall includes a pair second gusset panels having opposite side edges separated from adjacent sidewalls by a cut line and being defined by two identical coextensive panels having the same height as the side walls and folded upwardly out of the plane of the bottom wall and perpendicular thereto when the adjustable container is in the contracted position.

11. The adjustable container of claim 10 further comprising an adjustable sleeve being used to securely cover the adjustable container during shipping and transportation.

12. The adjustable container of claim 10 wherein each of the first gusset panels is used as a partial divider within the interior space container.

13. The adjustable container of claim 10 wherein the second gusset panels is configured to be a center divider within the interior space of the container.

14. The adjustable container of claim 10 wherein the second gusset panels is configured to be laid flat within the interior space of the container.

15. A container having an adjustable length so that the container can be folded into a shortened position for shipping and an extended position for use, wherein the container comprises:

a bottom wall, opposite side walls, and opposite end walls;

first gusset panels in the side walls joined along fold lines extending perpendicular to the bottom wall, the first gusset panels having bottom edges separated from the bottom wall by a cut and having an unfolded position extending coplanar with one another and with the associated respective side walls and a folded position in which the first gusset panels in each respective sidewall are folded inwardly with respect to the associated side wall; and second gusset panels in the bottom wall joined along fold lines extending transversely of the bottom wall, the second gusset panels having opposite side edges separated from adjacent side walls by a cut line and having unfolded position extending coplanar with one another and with the bottom wall and a folded position folded upwardly out of the plane of the bottom wall wherein the length of the container is shortened when the first and second gusset panels are folded out of plane of their respective side walls and bottom wall.

* * * * *